US005407040A

United States Patent [19]

Hu

[11] Patent Number: 5,407,040

[45] Date of Patent: Apr. 18, 1995

[54] BAGGAGE

[75] Inventor: Shih-Che Hu, Tainan Hsien, Taiwan, Prov. of China

[73] Assignee: Yih Kai Enterprise Co., Ltd., Tainan Hsien, Taiwan, Prov. of China

[21] Appl. No.: 200,344

[22] Filed: Feb. 23, 1994

Related U.S. Application Data

[63] Continuation-in-part of Ser. No. 82,334, Jun. 24, 1993.

[51] Int. Cl.[6] ..... A45C 3/00

[52] U.S. Cl. ..... 190/100; 16/115; 190/112

[58] Field of Search ..... 190/100, 115, 18 A, 190/109, 111, 114, 122, 124, 112; 206/279, 284, 288, 289; 16/115

[56] References Cited

U.S. PATENT DOCUMENTS

| | | | |
|---|---|---|---|
| 1,292,493 | 1/1919 | Logan | 206/279 X |
| 2,350,606 | 6/1944 | Gold | 206/284 |
| 3,236,538 | 2/1966 | Johansen | 190/18 A X |
| 4,256,320 | 3/1981 | Hager | 190/18 A X |
| 4,508,202 | 4/1985 | Siegert et al. | 190/18 A X |
| 4,577,877 | 3/1986 | Kassai | 16/115 X |
| 4,759,431 | 7/1988 | King et al. | 190/115 X |
| 4,925,021 | 5/1990 | Pulichino, Jr. | 206/279 |
| 5,343,988 | 9/1994 | Bartsch et al. | 190/115 X |
| 5,355,980 | 10/1994 | Hsieh | 190/18 A X |

*Primary Examiner*—Allan N. Shoap
*Assistant Examiner*—Christopher McDonald
*Attorney, Agent, or Firm*—Pro-Techtor International

[57] ABSTRACT

A piece of baggage comprising two half bodies and a middle body combined between the two half bodies by shafts, each half body having a projecting board at both bottom sides, a projection on the projecting board fitting and moving in a curved slot of a side board of a top board of the middle body to enable each half body to open or close in a limited route, the middle body having a top board and a bottom board screwed together, each half body possible to be opened separately or at the same time without forming any projecting-up wall in the middle to make clothes put therein get wrinkled.

6 Claims, 12 Drawing Sheets

BAGGAGE

This is a continuation-in-part application of U.S. patent application Ser. No. 08/082,334 filed on Jun. 24, 1993.

BACKGROUND OF THE INVENTION

A conventional piece of baggage shown in FIG. 1 comprises two half bodies A0, A1 combined together, having a middle protruding-up wall A2 dividing the two half bodies. And the middle wall A2 consists of a spherical wall A00 of the half body A0 and A1, forcing large clothes like overcoats, trousers, raincoats placed therein to get wrinkled. Known hard baggage such as U.S. Pat. Nos. 3,967,708, 5,044,476, 4,787,488 all have the same disadvantage just mentioned.

Conventional pieces of soft baggage made of canvas of the like such as U.S. Pat. Nos. 1,292,493, 3,559,777, 4,925,021, 4,887,700 and 2,350,606 are made by sewing and have a hard material inside soft canvas, without any special structure, and some them, U.S. Pat. Nos. 1,292,493, 3,559,777 and 2,350,606 do not have a protruding-up middle wall. But the soft baggage has disadvantages of easy breaking and short endurance.

Conventional pieces of baggage affixed with a pulling grip used as a baggage cart are known in U.S. Pat. Nos. 4,759,431, 3,805,929, 4,340,132, 4,838,396, 4,928,800, 5,048,649, 4,561,526, and 4,299,313. Those U.S. Pat. Nos. 3,805,929, 4,928,800, 4,561,526 and 4,299,313 have pulling grip fixed on a side of the baggage body and seingable to be pulled for carrying the baggage. Those U.S. Pat. Nos. 4,340,132, 5,408,629 and 4,759,431 have pulling grip shrinkably affixed on a side of the baggage body by means of an engaging component such as a bevelled head 164 shown in FIG. 9 of the U.S. Pat. No. 4,759,431. But in practical use, the engaging component by which the pulling grip can be pulled out or pushed in has to be pushed down with one hand, and the pulling grip has to be pulled or pushed with the other hand, to a resultant inconvenience in handling.

SUMMARY OF THE INVENTION

This invention has been devised to offer a kind of baggage, improved in the disadvantages mentioned above, and having features listed below.

1. It consists of two half baggage bodies and a middle body combined between the two half baggage bodies by means of shafts, enabling the two half bodies to be opened without forming a middle projecting wall to make clothes wrinkled.

2. A slide projection is provided on a projecting board at both sides of each of two half body, and the slide projections fit and move along in curved slots in the middle body so that the two half bodies can be opened or closed according to a definite route limited by the curved slots.

3. The middle body consists of a top board and a bottom board combined together with screws, with rollers being fixed on the bottom board to move on the ground, with the top board connected with the two half bodies with shafts, and with two side vertical boards fixed at both sides having a curved slot for the slide projection and the screw in item 2 to fit therein.

4. A hand grip is provided for carrying, secured by two projecting posts inserting through an upper side of an upper half body screwed with a stop plate fixed on an inner wall of the upper half body.

5. A hanger supporter is provided to secure a hanger for clothes, secured downward with the stop plate as if the hanger would be carried by the hand grip.

6. A slidable bar guider is provided in the upper half body and covered with a cap.

7. A pulling grip has a slidable bar to rest and move on the slidable bar guider back and forth in a limited route.

8. A pulling block with a finger hole is provided to be deposited below a curved groove of the slidable bar so as to handle with one hand to let the pulling grip to extend out or retreat in.

9. The pulling block has a recovery spring being hooked with a pulling wire, which has the other end hooked with one end of a tenon, and then the pulling block is pulled manually to pull the tenon so that the extended-out pulling grip may be retracted back along the slidable bar guider in the baggage.

10. The pulling components of the pulling grip is provided half hidden and half exposed so that processing and handling of them are easy.

DETAILED DESCRIPTION OF THE INVENTION

Figure 1:
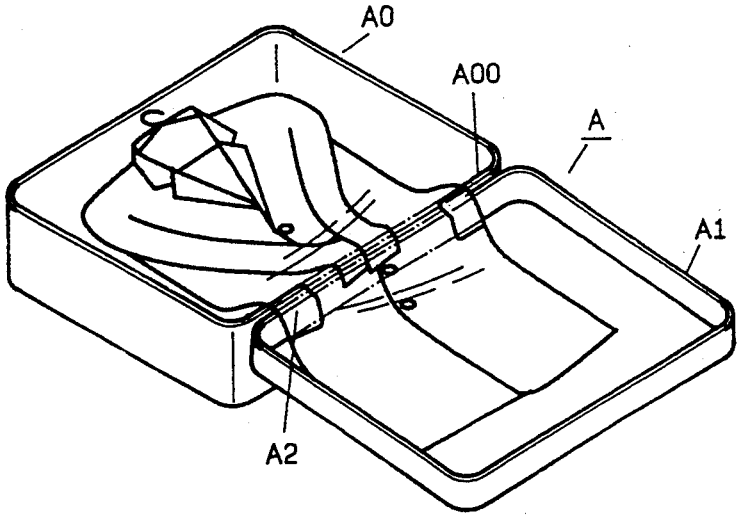
Fig 1 (PRIOR ART)
FIG. 1 is a perspective view of a conventional piece of baggage.
Figure 2:
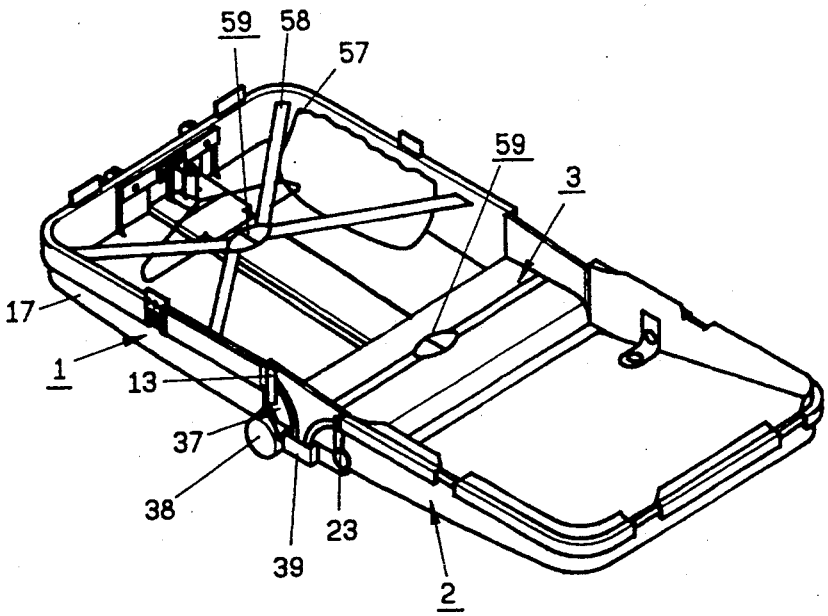
FIG. 2 is a perspective view of an open piece of baggage in the present invention.
Figure 3:
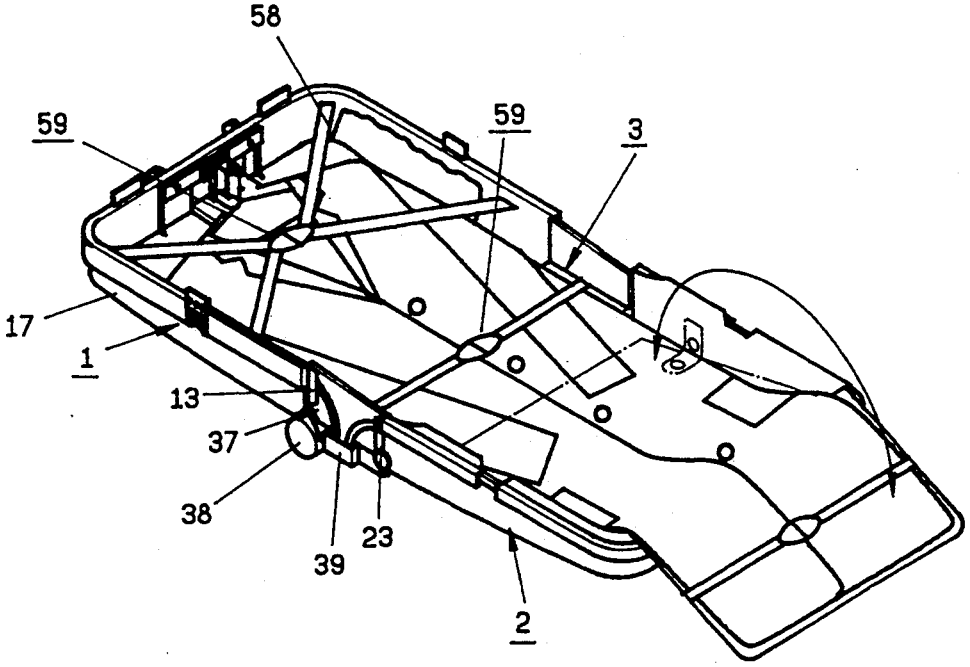
FIG. 3 is another perspective view of the open piece of baggage in the present invention.
Figure 5:
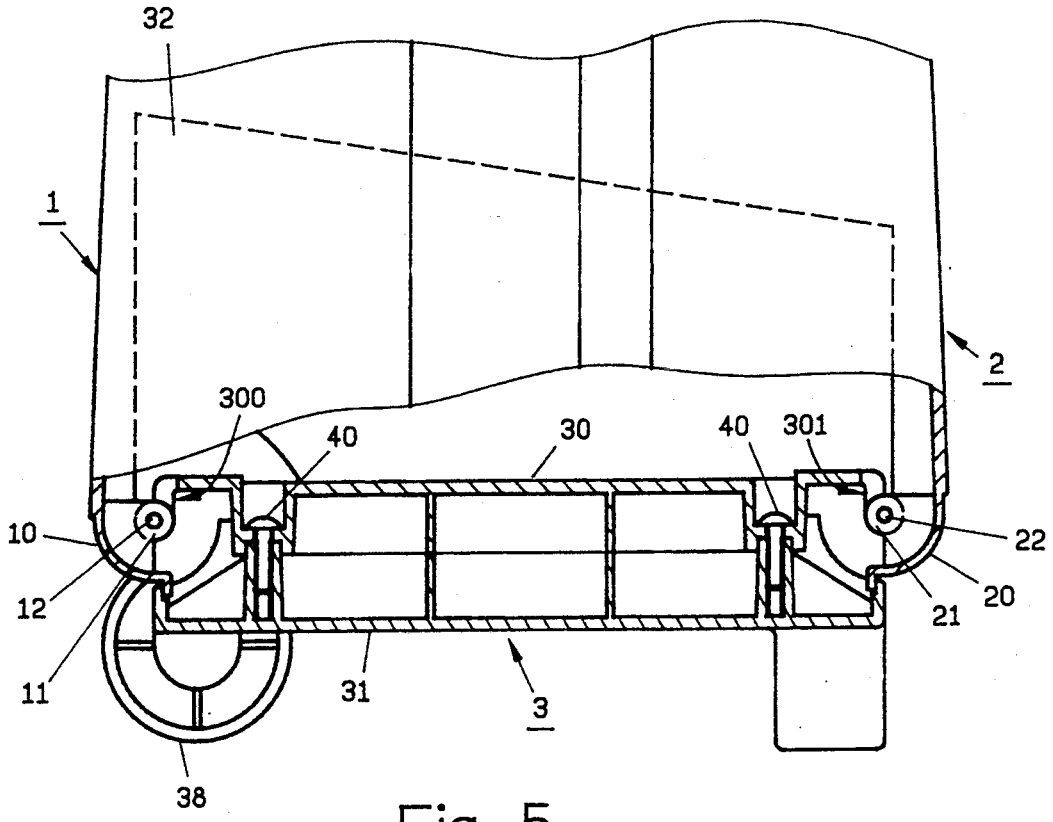
FIG. 5 is a partial cross-sectional view of the middle body combined with the two half baggage bodies in the baggage in the present invention.

A piece of baggage in the present invention, as shown in FIGS. 2 and 3, comprises at least two half bodies 1, 2 and a middle body 3 combined together. The two half bodies 1, 2 may be of the same dimensions or of different dimensions, having respectively a bottom side 10, or 20, which is each formed with a straight shaft base 11, 21 as shown in FIG. 5. The shaft base 11 or 12 is in a crossing condition with a shaft base 300 or 301 of a top board 30 of the middle body 3. Two long shafts 12, 22 are provided to extend in the two opposite shaft bases 11, 21 of the two half bodies 1, 2 and the shaft bases 300, 301 of the middle body 3, enabling the two half bodies 1, 2 to swing open outward in relation to each other.

Figure 4:
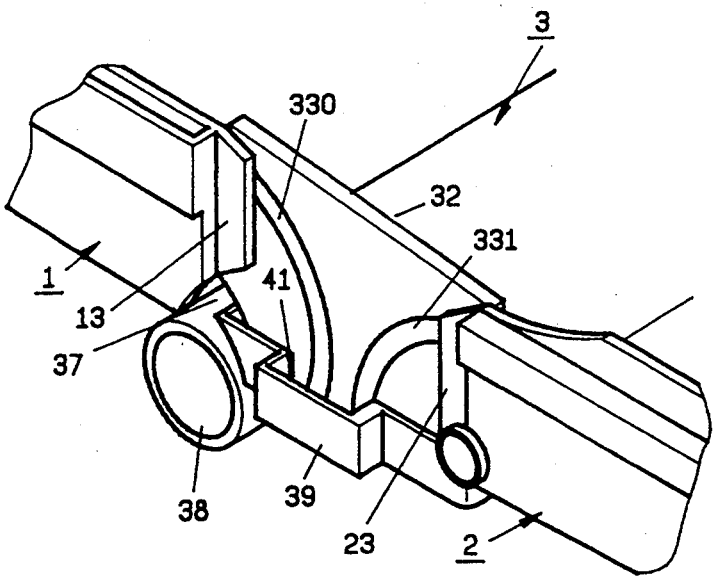
FIG. 4 is a perspective view of a middle body and two half baggage bodies of the baggage in the present invention.
Figure 6:
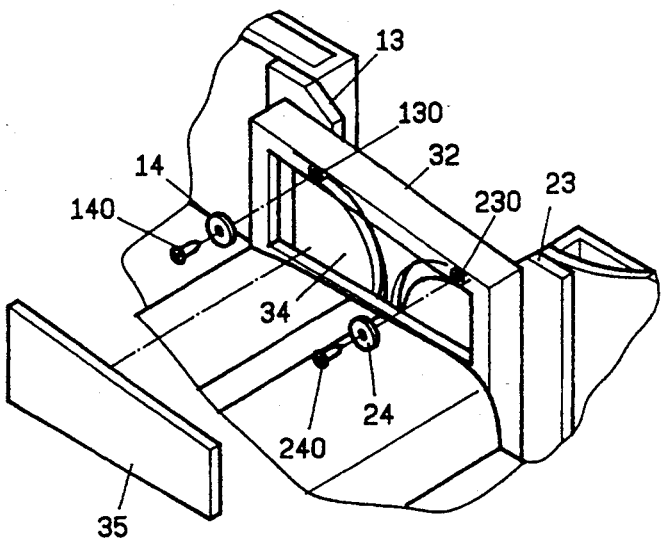
FIG. 6 is an partial exploded perspective view of the middle body combined with the two half baggage bodies in the baggage in the present invention.

Each of the two half bodies 1, 2 has a projecting board 13 or 23 at a left or a right side, and each projecting board 13 or 23, as shown in FIGS. 4 and 6, has a slide projection 130 or 230 secured in a curved slot 330 or 331 of each of two side boards 32 at both sides of a top board 30 of the middle body 3 with a screw 140 or 240 and a washer 14 or 24. The screw 140 or 240 screws in the projection 130 or 230 and moves along in the curved slot 330 of 331, and the washer 14 or 24 also slides along an inner wall 34 of each of the side boards 32 with the screw 140 or 240 so as to enable either of the half bodies 1, 2 to open or close according to a definite route limited by the curved slots 330, 331.

Figure 7:
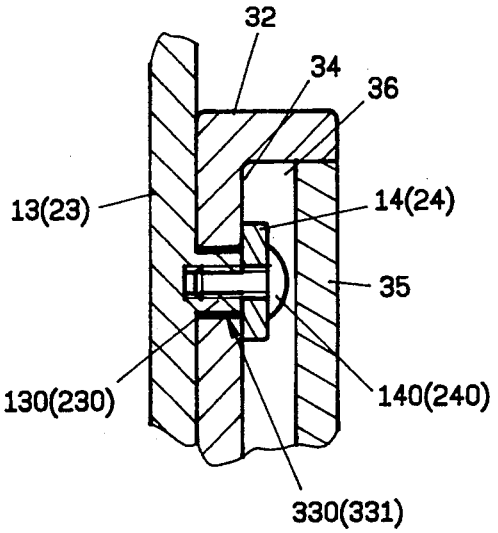
FIG. 7 is an enlarged partial cross-sectional view of the middle body combined with the two half baggage bodies in the baggage in the present invention.

The middle body 3 as shown in FIG. 5 is combined between the two half bodies 1, 2, having a top board 30 and a bottom board 31 spaced apart parallel with a distance and combined together with screws 40. The top board 30 has a vertical side board 32 at both sides, and each side board 32 has a curved slot 330 or 331, and a closing board 35 provided to close up an inner side to form an enclosed cavity 36. The screw 140 or 240 fits and moves in the curved slot 330 or 331 and the washer 14 or 24 moves with the screw, allowing the slide projection 130 or 230 moves also along in the curved slot 330 or 331 as shown in FIG. 7. The bottom board 31 has a roller groove 37 at both sides for fixing a roller 38 therein, and an extension wall 39 at both side to form a combining cavity 41 for the projection board 13, or 23 to fit therein to keep the baggage completely closed up when the two half bodies 1, 2 are closed against each other.

Figure 8:
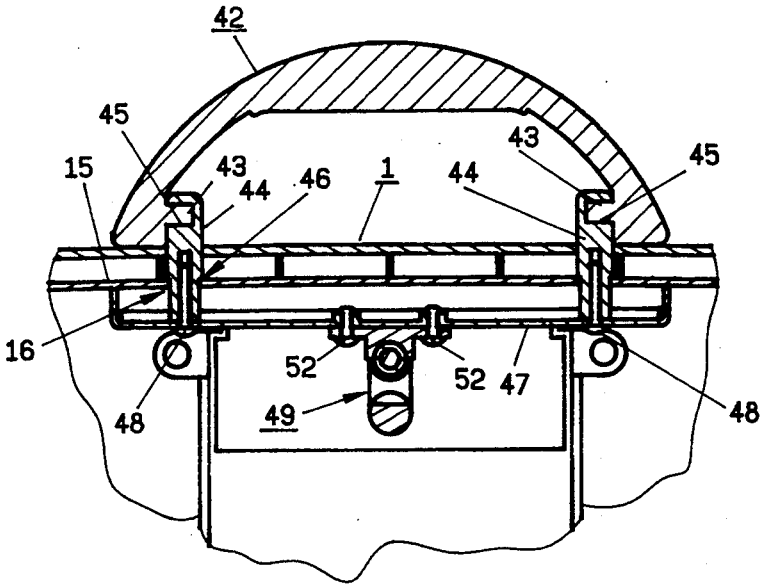
FIG. 8 is a cross-sectional view of a handle grip combined with the baggage body in the baggage in the present invention.
Figure 9:
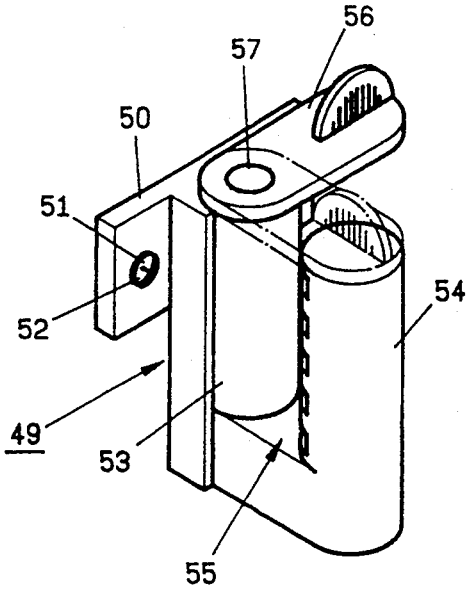
FIG. 9 is a perspective view of a hanger supporter in the baggage in the present invention.

The upper half body 1 has a hand grip 42 fixed on a top side as shown in FIG. 8, and the hand grip 42 has two opposite round pins 43 extending inward from both bottom sides to fit in two pin holes 45 of two projecting posts 44 provided to insert through the top side of the upper half body 1. Then the hand grip 42 can be moved to the left and the right by means of the combination of the pins 43 and the pin holes 45. Each projecting post 44 has an annular groove 46 fitting with a hole 16 in an inner wall of the upper half body 1, and its bottom resting on a stop plate 47 and secured by two screws 48 screwing in the post 44 from under the stop plate 47, and thus fixing the handle grip 42 and the posts 44, 44 firmly. The stop plate 47, as shown in FIGS. 8 and 9, is combined with a hanger supporter 49 fixed on an intermediate portion of the stop plate 47 by means of screws 52. The hanger supporter 49 has a locating plate 50 bored with locating holes 51 for screws 52 to pass through to screw in the stop plate 47, two vertical columns 53, 54 defining a space 55 between them, which is to be closed on top by a closing plate 56 attached pivotally on the column 53 with a pin to swing with the pin as a pivot.

Figure 10:
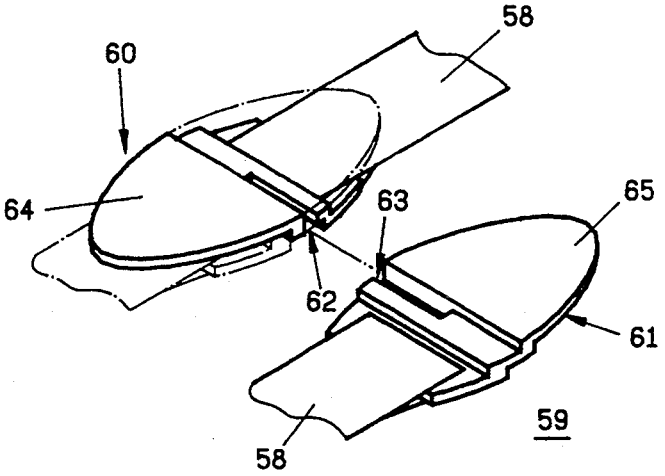
FIG. 10 is an exploded perspective view of a fastener of the baggage in the present invention.

Several elastic bands 58 as shown in FIGS. 2, 3 and 10 are provided in each half bodies 1, or 2, for keeping clothes put therein, each having a fastener 59 consisting of an upper half fastener 60 and a lower half fastener 61, and each of them has an open groove 62 or 63 and an actuating piece 64 or 65 so that the open groove 62 or 63 hooks with each other to hook the upper and the lower half fasteners together. To unhook them, the lower half fastener 60 is to be pushed sideways from the lower half fastener 61.

Figure 11:
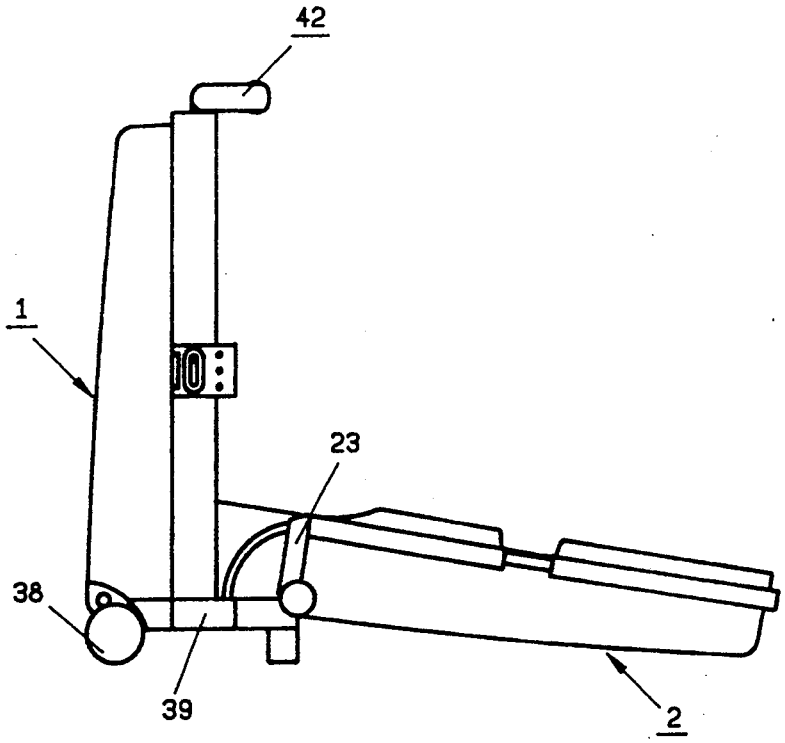
FIG. 11 is a side view of an upper half body opened from a lower half body in the baggage in the present invention.
Figure 12:
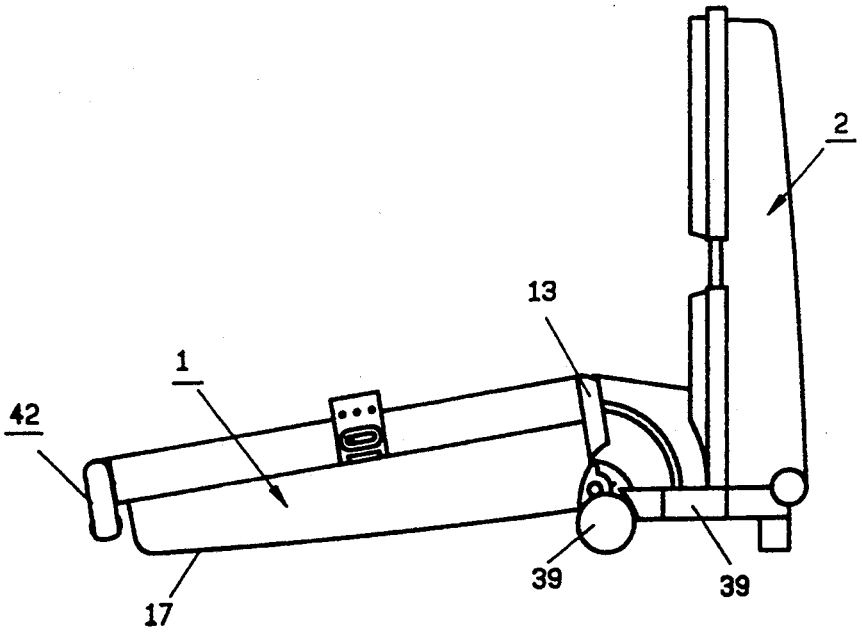
FIG. 12 is a side view of the lower half body opened to stand upright in the baggage in the present invention.

As understood from the description mentioned above, this piece of baggage can be opened in three fashions shown in FIGS. 2, 11 and 12, with the two half bodies 1, 2 lying flatly on the floor, or with the upper or the lower half bodies 1 or 2 standing upright on the floor, facilitating the clothes put therein taken out freely.

Figure 13:
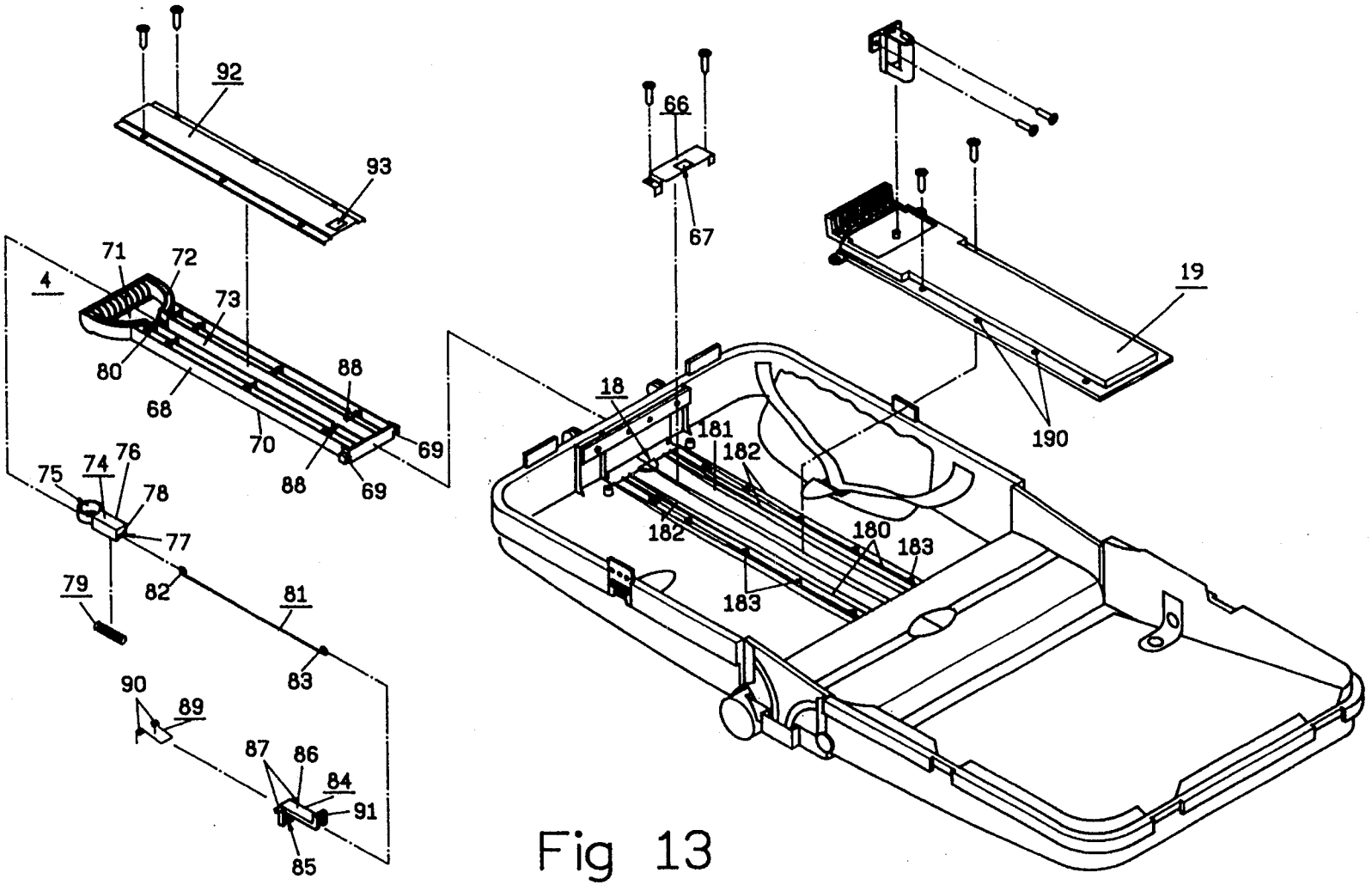
FIG. 13 is a partial exploded perspective view of the baggage in the present invention.
Figure 14:
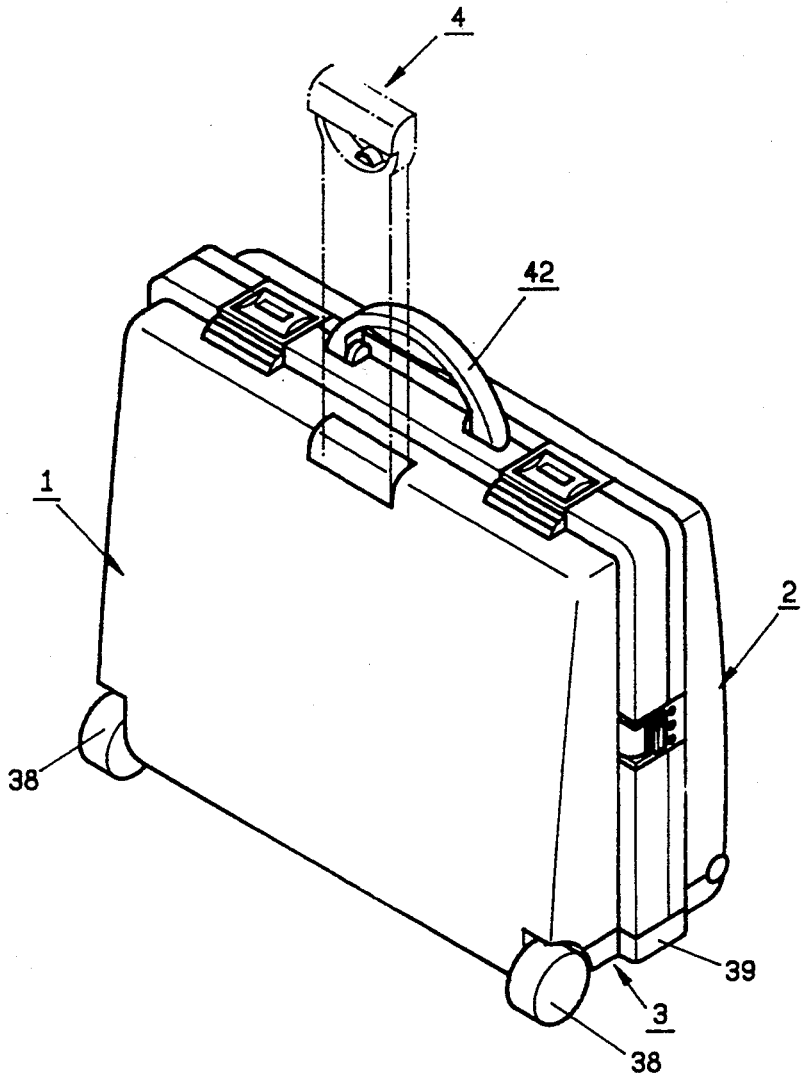
FIG. 14 is a perspective view of the baggage in the present invention.
Figure 15:
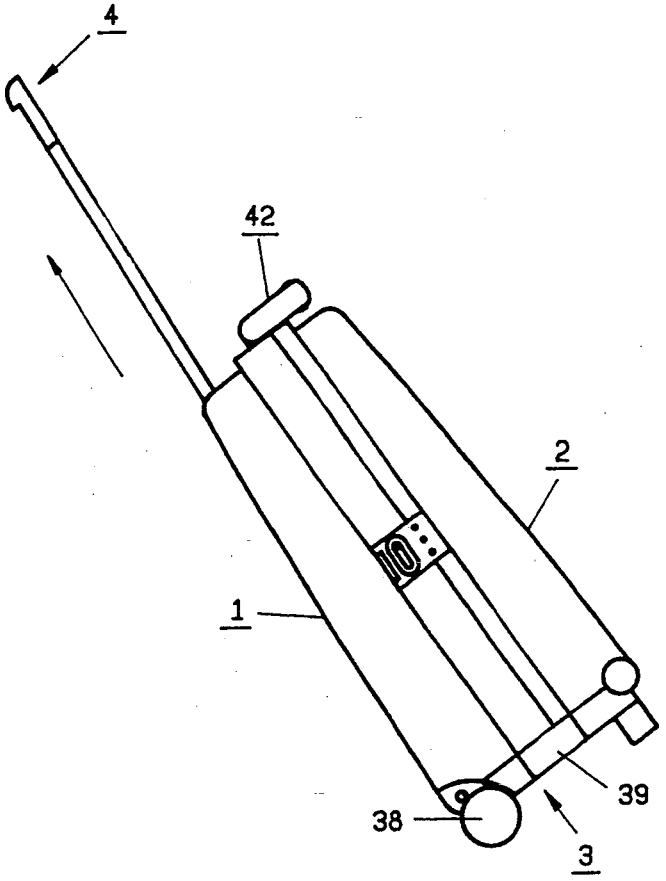
FIG. 15 is a side view of the baggage being moved by pulling a pulling grip of the baggage in the present invention.
Figure 16:
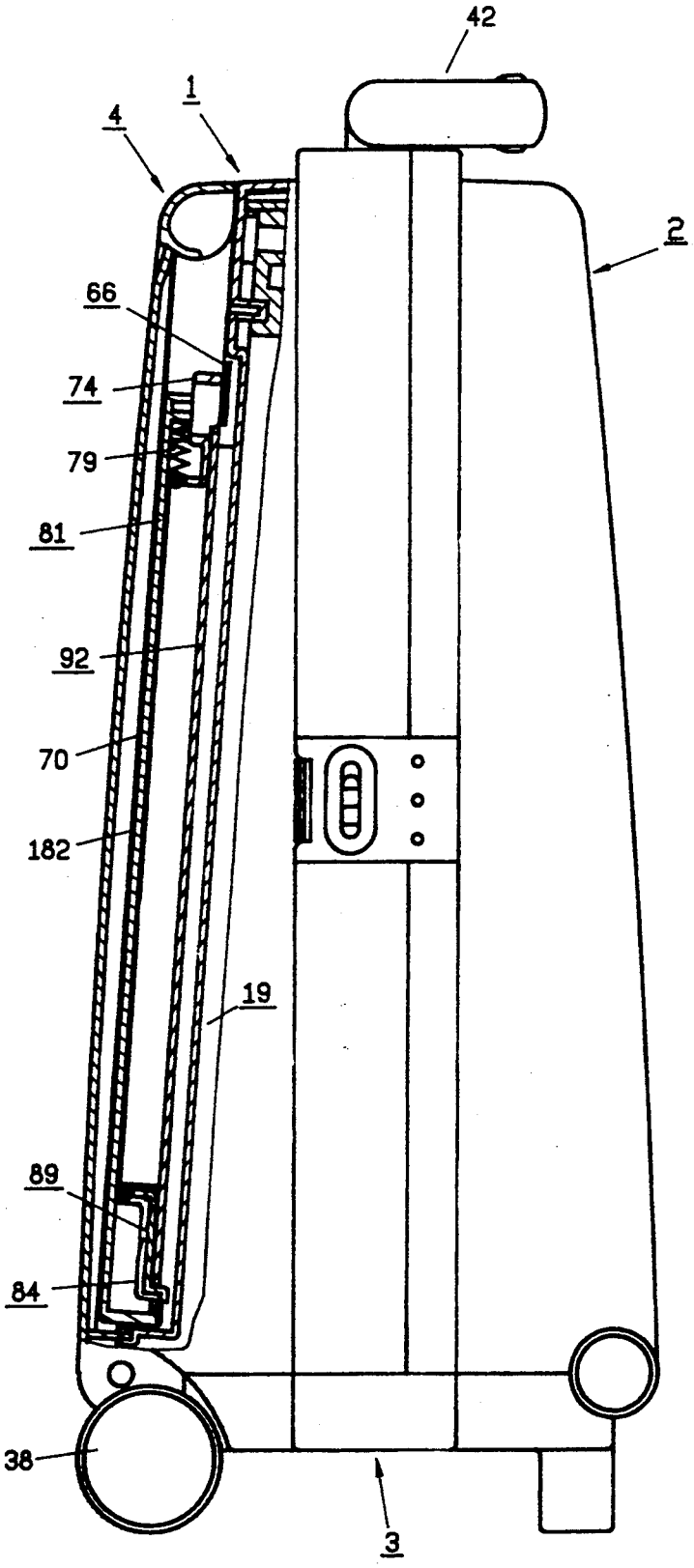
FIG. 16 is a cross-sectional view of the pulling grip combined with the baggage body in the present invention.

A slidable bar guider 18 shown in FIG. 13 is provided on the inner wall of the upper half body 1, extending out of the top side 17 for a pulling grip 4 to fit with and slide along so that the pulling grip 4 may be pushed in the upper half body 1 or pulled to extend out thereof for pulling the baggage with help of the rollers 38 on the ground. The slidable bar guider 18 has two guide rails 180 for two guide grooves 69 of a slidable bar 68 to fit with so the slidable bar 68 of the pulling grip 4 may slide along. Several long projections 182 are provided on the inner wall of the upper half body 1 to contact outer sides 70 of the slidable bar 68 as shown in FIG. 16, forcing the slidable bar 68 tightly fit with the slidable bar guider 18. And many screw bases 183 are provided on the two sides of the slidable bar guider 18 for screws to engage screw holes 190 in a cap 19, which then is secured to cover the slidable bar guider 18. Besides, a hook hole plate 66 is provided to be deposited on an upper portion of the slidable bar guider 18 with two screws, having a hook hole 67 for a tenon hook 91 to engage therein.

Figure 17:
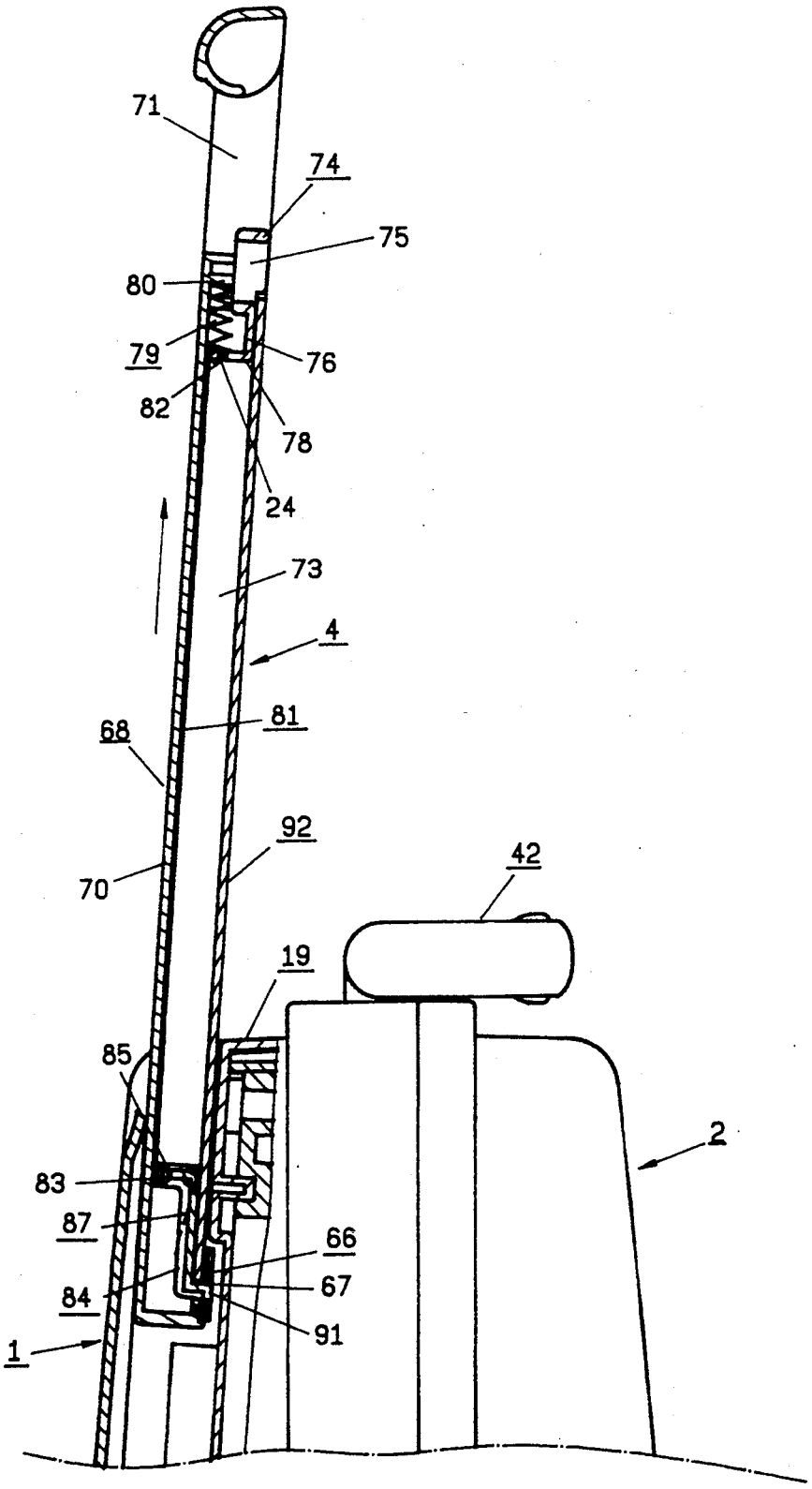
FIG. 17 is a cross-sectional view of the pulling grip being extended out in the baggage in the present invention.
Figure 18:
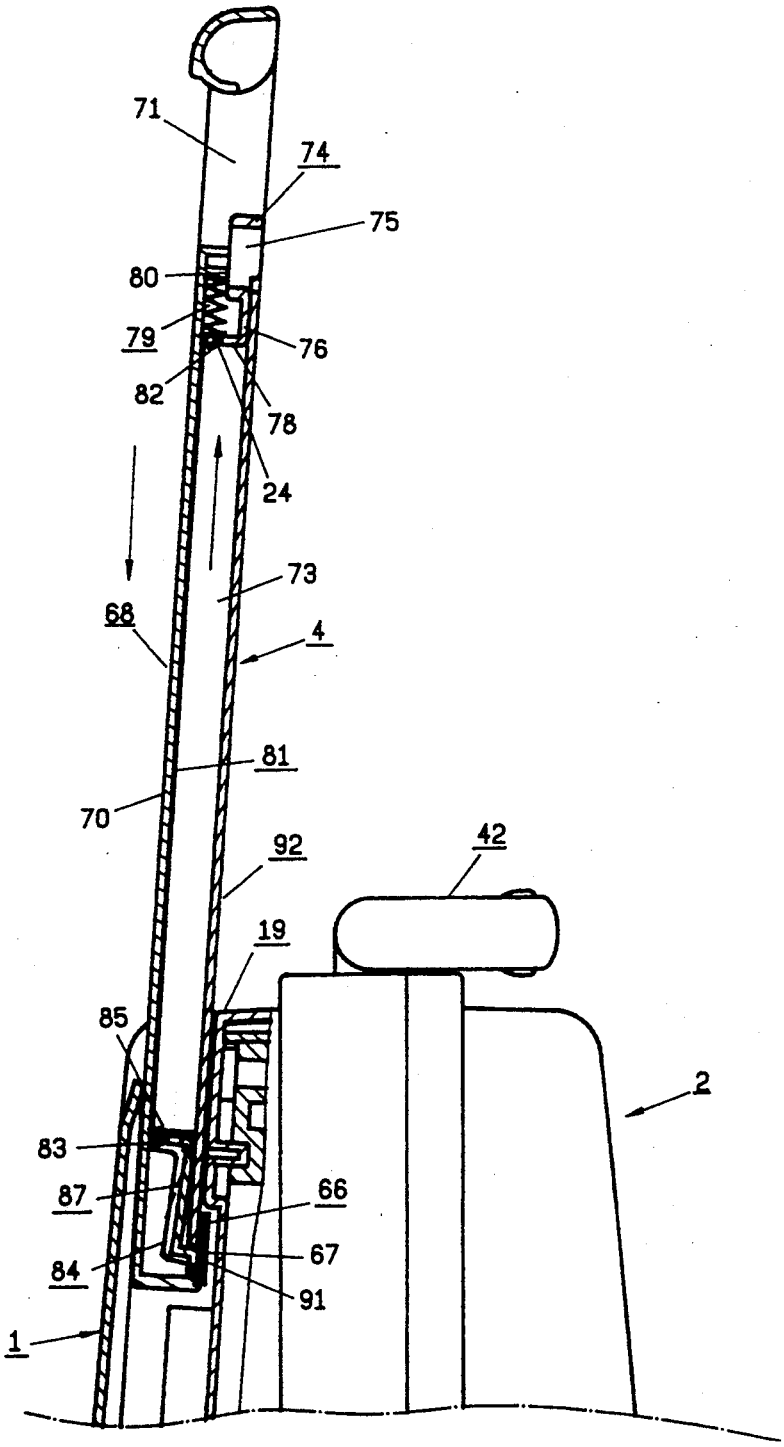
FIG. 18 is a cross-sectional view of the pulling grip being retracted back in the baggage in the present invention.

A pulling grip 4 has the slidable bar 68, a curved wall 70 at top of the bar 68 for fingers of a hand to pass through for gripping, and an opening 72 leading to a combining cavity 73, a pulling block 74 with a finger hole 75 to extend therein. The pulling block 74 has an inverted U-shaped wall surface 76 and a pulling wire hole 77 in a lower wall of the surface 76, a recovery spring 79 having one end resting on a wall 78 of the wire hole 77 and having the other end contacting a side wall 80 defining the cavity 73 so that the pulling block 74 may be pulled or released, compressing or releasing the recovery spring 79 to let the pulling components just mentioned to move back to its original position. The pulling wire 81 has one end 82 hooked in the pulling wire hole 77 and the other end 83 hooked in a pulling wire hole 85 of a tenon 84. The tenon 84 has an inverted U-shaped surface 86, two pins 87, 87 on both sides of the surface 86 to fit in two pin holes 88 in the side wall defining the combining cavity 73 of the pulling grip 4. A U-shaped twist spring 89 is provided, having two ends 90 fixed on the pins 87, 87 and contacting a rear side of the tenon 84 as shown in FIGS. 16, 17, 18 so that a tenon hook 91 may protrude through a hook hole 93 of an outer lid 92, and thus the pulling components mentioned above may be disposed in the slidable bar 68, and an outer lid 92 is screwed tightly in the slidable bar 68. Then the pulling grip 4 has been completed.

When the pulling grip 4 is used to move the baggage, a hand is inserted through the curved cavity of the grip 4 to pull the slidable bar 68 from the guide bar guider 18 to the highest position. Then the tenon hook 91 hooks the hook hole 67 of the hook hole plate 66 as shown in FIG. 17, securing the pulling grip 4 at the extended position. If the pulling grip 4 is to be retreated or pushed back in the upper half body 1, any finger of the hand gripping the grip 4 is inserted in the finger hole 75 and pull it a little upward, then the tenon hook 91 may disengage from the hook hole 67 of the hook hole plate 66 as shown in FIG. 18. Then the pulling grip 4 can be pushed inward, forcing the slidable bar 68 slide along the slidable bar guider 18 to deepest position.

What is claimed is:

1. A piece of baggage comprising at least;

two half baggage bodies—one the upper and the other the lower—respectively having a shaft base at the bottom, a projecting board at two sides and a slide projection secured with a screw and a washer at both sides of said projecting board;

a middle body being combined between said two half baggage bodies, having a top board and a bottom board combined together with screws, a straight shaft base respectively provided at both sides of the top board to intersect with said shaft base of said two half baggage bodies, and a long shaft provided to extend in said straight shaft base, said top board provided with two vertical side boards at both sides, said side boards respectively having a curved slot for the screw fixed in said slide projection of said projecting board of each said half baggage body to fit and move along therein, said washer of said slide projection being rested and slide along on an inner wall of the curved slot; and said two half baggage bodies and the middle body being combined together with said shaft bases with said shafts extending therein so that said two half baggage bodies may separately or at the same time be swung open or close, guided by said slide projections with the screws sliding in said curved slots of said side boards of said middle body.

2. The baggage as claimed in claim 1, wherein said side boards of said top board of said middle body has a closing board to close up an inner side, forming an inner cavity in said side board.

3. The baggage as claimed in claim 1, wherein said bottom board of said middle body has an extension wall at both sides for defining a combining cavity for said projecting boards of said half baggage bodies to extend therein when said two half baggage bodies ard closed against each other.

4. The baggage as claimed in claim 1, wherein a hand grip is provided on either of said half baggage bodies, said hand grip has two opposite round pins extending inward from both ends to engage with two pin holes of two posts protruding into the top side of each said half baggage body to screw with a stop plate so as to secure said hand grip firmly.

5. A pulling grip for baggage comprising;

two half baggage bodies, one of them having a slidable bar guider on an inner wall for a slidable bar of the pulling grip to rest on and move back and forth;

a hook hole plate provided on an upper portion of the slidable bar guider and having a hook hole, two guide rails provided in a bottom of said slidable bar guider, and several long projections provided inside said guide rails;

a cap provided to cover on said slidable bar guider;

a pulling grip having a slidable bar, which has a guide groove at both sides to fit with each said guide rail and a curved wall at the top and an opening below said curved wall for a finger hole of a pulling block to extend therein; and said slidable bar having a central straight opening for depositing a pulling block therein, a recovery spring being deposited between said pulling block and said central straight opening, one end of a pulling wire being hooked in a wire hole of said pulling block, the other end of said pulling wire being hooked in a wire hole of a tenon, said tenon having two pins inserting in two pin holes of said slidable bar to secure a U-shaped twist spring resting on a rear side of said tenon, pulling manually said pulling block disengaging the hook of said tenon from said hook hole of said hook hole plate to enable said pulling grip pushed along said slidable bar guider into the baggage.

6. The baggage as claimed in claim 5, wherein said pulling wire is either of a string shape or of a plate shape.

* * * * *